US011454398B2

(12) United States Patent
Bothien et al.

(10) Patent No.: US 11,454,398 B2
(45) Date of Patent: Sep. 27, 2022

(54) MIXER

(71) Applicant: Ansaldo Energia Switzerland AG, Baden (CH)

(72) Inventors: Mirko Ruben Bothien, Zürich (CH); Alessandro Scarpato, Wettingen (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 7 days.

(21) Appl. No.: 17/174,939

(22) Filed: Feb. 12, 2021

(65) Prior Publication Data

US 2021/0172606 A1 Jun. 10, 2021

Related U.S. Application Data

(63) Continuation of application No. 15/907,953, filed on Feb. 28, 2018, now abandoned.

(30) Foreign Application Priority Data

Mar. 2, 2017 (EP) ..... 17159008

(51) Int. Cl.
*F23R 3/34* (2006.01)
*F23R 3/06* (2006.01)
(Continued)

(52) U.S. Cl.
CPC ..... *F23R 3/346* (2013.01); *F23R 3/00* (2013.01); *F23R 3/002* (2013.01); *F23R 3/045* (2013.01);
(Continued)

(58) Field of Classification Search
CPC ..... F05D 2260/964; F23C 6/04; F23C 6/042; F23D 11/102; F23D 11/40; F23D 14/02;
(Continued)

(56) References Cited

U.S. PATENT DOCUMENTS 4,475,344 A 10/1984 Mumford et al.
7,886,545 B2 2/2011 Lacy et al.
(Continued)

FOREIGN PATENT DOCUMENTS

CN 101622048 A 1/2010
CN 101818704 A 9/2010
(Continued)

OTHER PUBLICATIONS

First Office Action dated Oct. 12, 2020, by the Chinese Patent Office in corresponding Chinese Patent Application No. 201810174380.9, and an English Translation of the Office Action. (10 pages).
(Continued)

*Primary Examiner* — Scott J Walthour
(74) *Attorney, Agent, or Firm* — Buchanan Ingersoll & Rooney PC

(57) ABSTRACT

A mixer having a housing, a duct within the housing, a first and a second injector arranged to inject a fluid at a centre zone of the duct, a third and a fourth injector arranged to inject the fluid at a wall zone of the duct. The first/third injectors are at a distance D1=$v/2f_1$ or odd integer multiples of it from the second/fourth injectors in the absence of an acoustic node between them, or at a distance D1=$\lambda_{conv}=v/f_1$ or full wave length integer multiples of it in the presence of an acoustic node between them. Advantageously $f_1$ is greater than $f_2$.

18 Claims, 4 Drawing Sheets

(51) Int. Cl.
*F23R 3/04* (2006.01)
*F23R 3/28* (2006.01)
*F23R 3/00* (2006.01)

(52) U.S. Cl.
CPC ..... *F23R 3/06* (2013.01); *F23R 3/283* (2013.01); *F23R 2900/00014* (2013.01); *F23R 2900/03341* (2013.01)

(58) Field of Classification Search
CPC .... F23D 14/48; F23D 14/64; F23D 2203/007; F23D 2700/025; F23M 20/005; F23R 3/002; F23R 3/045; F23R 3/06; F23R 3/16; F23R 3/18; F23R 3/20; F23R 3/283; F23R 3/286; F23R 3/346; F23R 2900/00013; F23R 2900/00014; F23R 2900/03341
See application file for complete search history.

(56) References Cited

U.S. PATENT DOCUMENTS 8,038,013 B2 10/2011 Chen et al.
8,302,377 B2 11/2012 Rasheed et al.
2008/0217239 A1 9/2008 Chen et al.
2010/0192536 A1 8/2010 Rasheed et al.
2010/0242482 A1 9/2010 Kraemer et al.
2012/0260665 A1 10/2012 Eroglu et al.
2013/0098044 A1 4/2013 Singh
2014/0096530 A1 4/2014 Chen
2014/0109588 A1 4/2014 Ciani et al.
2016/0177832 A1 6/2016 Tonon et al.
2016/0178200 A1 6/2016 Ciani et al.
2016/0178207 A1 6/2016 Bothien et al.
2016/0215984 A1* 7/2016 Bothien ..... F23R 3/16
2018/0252412 A1 9/2018 Bothien et al.

FOREIGN PATENT DOCUMENTS

EP 3037725 A1 6/2016
EP 3037726 A1 6/2016
EP 3037728 A1 6/2016

OTHER PUBLICATIONS

European Search Report of European Patent Application No. 17159008, dated Aug. 3, 2017.

* cited by examiner

MIXER

PRIORITY CLAIM

This application claims priority from European Patent Application No. 17159008.6 filed on Mar. 2, 2017, the disclosure of which is incorporated by reference.

TECHNICAL FIELD

The present invention relates to a mixer. In particular the mixer is part of a gas turbine and is used to supply dilution air into the hot gas passing through the gas turbine.

BACKGROUND

FIG. 1 schematically shows an example of a gas turbine; the gas turbine 1 has a compressor 2, a first combustion chamber 3, a second combustion chamber 4 and a turbine 5. Possibly between the first combustion chamber 3 and the second combustion chamber 4 a high pressure turbine is provided. During operation air is compressed at the compressor 2 and is used to combust a fuel in the first combustion chamber 3; the hot gas (possibly partly expanded in the high pressure turbine) is then sent into the second combustion chamber 4 where further fuel is injected and combusted; the hot gas generated at the second combustion chamber 4 is then expanded in the turbine 5.

Between the first combustion chamber 3 and the second combustion chamber 4 a mixer 7 can be provided in order to dilute with air (or other gas) the hot gas coming from the first combustion chamber 3 and directed into the second combustion chamber 4.

FIG. 2 schematically shows the section of the gas turbine including the first and the second combustion chambers 3, 4. FIG. 2 shows a first burner 3*a* of the first combustion chamber 3 where the compressed air coming from the compressor 2 is mixed with the fuel and a combustor 3*b* where the mixture is combusted generating hot gas (reference 20*a* indicates the flame). The hot gas is directed via a transition piece 3*c* into the mixer 7, where air is supplied into the hot gas to dilute it. The diluted (and cooled) hot gas is thus supplied into the burner 4*a* of the second combustion chamber 4 where further fuel is injected into the hot gas via a lance 8 and mixed to it. This mixture combusts in the combustor 4*b* by auto combustion (reference 20*b* indicates the flame), after a "delay time" from the injection into the second burner 4*a*.

The temperature in the second burner 4*a* can oscillate, typically because of mass flow oscillations of the air coming from the mixer 7 and directed into the second burner 4*a*.

The delay time depends on, inter alia, the temperature within the second burner 4*a*, such that temperature oscillations in the second burner 4*a* cause increase/decrease of the delay time and thus axial upwards/downwards oscillations of the flame in the combustor 4*b*.

In order to prevent these axial oscillations of the flame, the temperature in the second burner 4*a* has to be maintained constant and thus the flow emerging from the mixer 7 has to be maintained constant.

The mass flow through the mixer 7 can vary because within the mixer 7 pressure oscillations exist (e.g. due to the combustion in the combustor 3*b* and/or 4*b*); these pressure oscillations cause an increase/decrease of the flow of diluting air injected into the mixer.

In order to maintain this flow constant, multiple injectors can be provided at different axial locations of the mixer 7, in such a way that oscillating pressure air supplied through upstream injectors compensate for oscillating pressure air supplied trough downstream injectors. In other words, air is injected in such a way that high pressure air injected from upstream injectors reaches the downstream injectors when low pressure air is injected through them (and vice versa); this way the high pressure and low pressure compensate for one another and are cancelled, such that the pressure within the mixer 7 stays substantially constant; air injection into the mixer can thus be constant over time.

The inventors have found a way to improve cancellation of pressure oscillations (and thus mass flow oscillations) through the cross section of the mixer.

SUMMARY

An aspect of the invention includes providing a mixer with improved flow oscillation cancellation.

These and further aspects are attained by providing a mixer in accordance with the accompanying claims.

BRIEF DESCRIPTION OF THE DRAWINGS

Further characteristics and advantages will be more apparent from the description of a preferred but non-exclusive embodiment of the mixer, illustrated by way of non-limiting example in the accompanying drawings, in which.

DETAILED DESCRIPTION OF EXEMPLARY EMBODIMENTS

Figure 4:
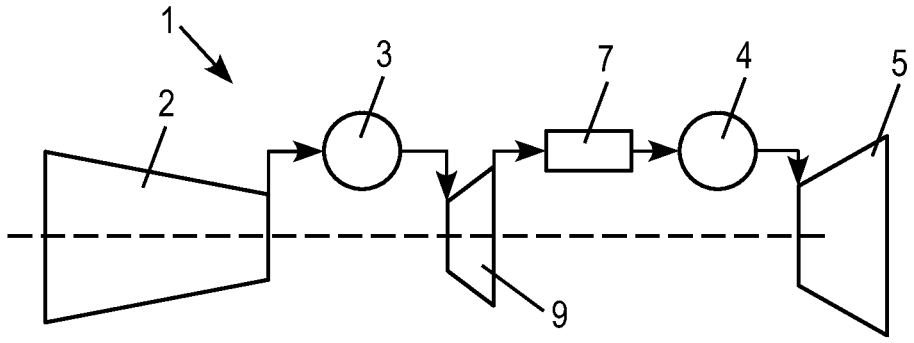
FIG. 4 shows a different embodiment of the gas turbine.

With reference to the figures, these show the gas turbine 1 with the compressor 2, the first combustion chamber 3, the second combustion chamber 4 fed with a fluid coming from the first combustion chamber 3, the turbine 5. Between the first combustion chamber 3 and the second combustion chamber 4 it is provided the mixer 7. In addition, between the first combustion chamber 3 and the second combustion chamber 4 (upstream or downstream of the mixer 7), a high pressure turbine can be provided (FIG. 4, turbine 9).

The mixer 7 comprises a housing 10, a duct 11 within the housing 10, a first injector 12 arranged to inject a fluid at the centre zone of the duct 11, a second injector 13 arranged to inject a fluid at the centre zone of the duct 11, a third injector 14 arranged to inject a fluid at the wall zone of the duct 11 and a fourth injector 15 arranged for injecting a fluid at the wall zone of the duct 11. Additional injectors can also be provided.

Each injector can comprise a row of nozzles 16 extending over the circumference or perimeter of the duct 11; in addition each injector can comprise a plurality of rows of nozzles close to one another. Additionally, nozzles 16 of different rows of nozzles of a same injector can have same or different penetration and/or nozzles 16 of a same row of nozzles can have different penetration.

Figure 1:
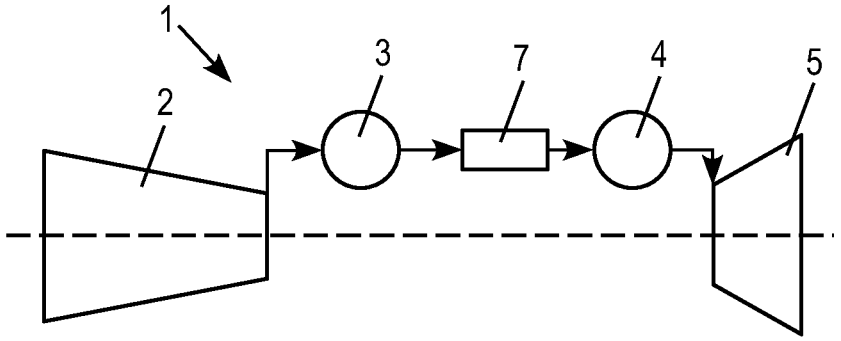
FIG. 1 schematically shows a gas turbine.
Figure 2:
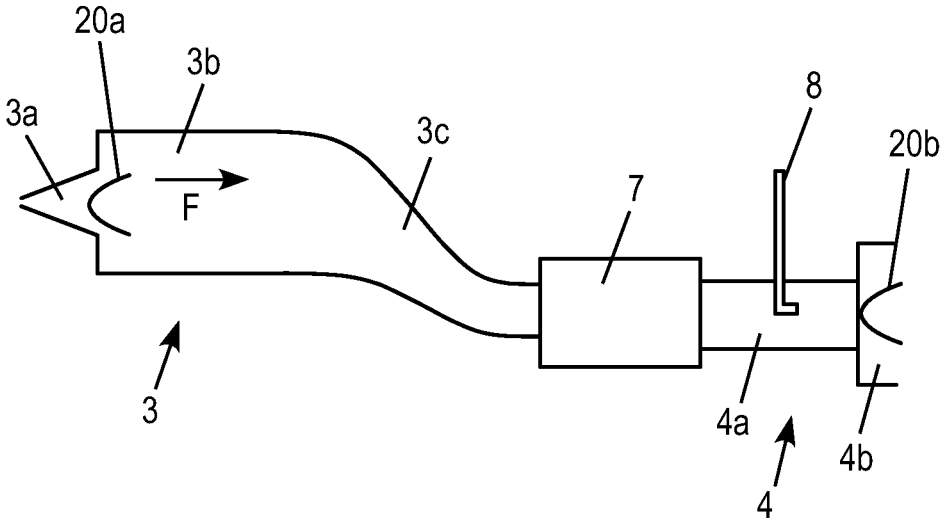
FIG. 2 schematically shows the first combustion chamber, mixer and second combustion chamber of the gas turbine of FIG. 1.
Figure 3:
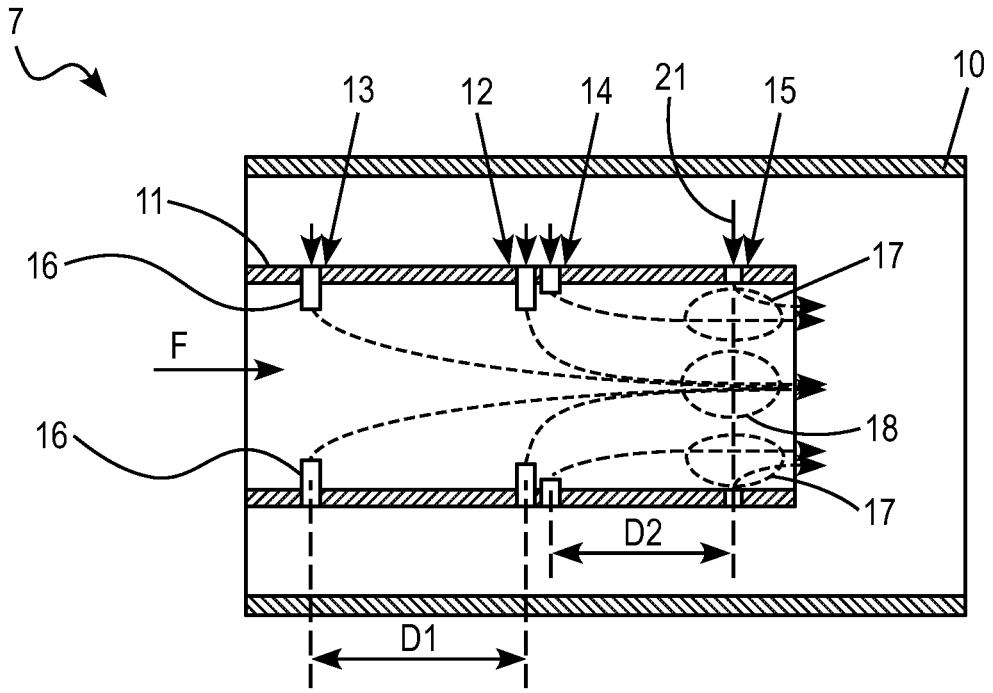
FIG. 3 shows a longitudinal section of a mixer.

For example, FIG. 3 shows an embodiment with injectors arranged for injecting the fluid at the centre zone and at the wall zone of the duct 11 that are provided close to one another.

In order to inject the fluid at the centre zone 18 of the duct 11 the first and second nozzles 12, 13 have a deep penetration into the duct 11; likewise in order to inject the fluid at the wall zone 17 of the duct 11 the third and fourth nozzles have a small penetration into the duct 11; generally the first and second injectors 12, 13 have a deeper penetration into the duct 11 than the third and fourth injectors 14, 15.

The relative position of the injectors can be any, i.e. any injector can be upstream and/or downstream of any other injector (upstream and downstream are referred to the fluid circulation direction identified by the arrow F in the figures).

The distance between the first injector 12 and the second injector 13 is, in case there is no acoustic node between them (i.e. in the absence of an acoustic node)

$$D1=\lambda_{conv}/2=v/2f_1$$

or an odd integer multiple of it. In case there is an acoustic node between the first and second injectors 12, 13 (i.e. in the presence of an acoustic node) the distance D1 is $$D1=\lambda_{conv}=v/f_1$$

or a full wave length integer multiple of it.

Likewise, the distance between the third injector 14 and the fourth injector 15 is, in case there is no acoustic node between them (i.e. in the absence of an acoustic node)

$$D2=\lambda_{conv}/2=v/2f_2$$

or an odd integer multiple of it. In case there is an acoustic node between the third injector 14 and the fourth injector 15 (i.e. in the presence of an acoustic node) the distance D2 is $$D2=\lambda_{conv}=v/f_2$$

or a full wave length integer multiple of it.

In the above formulas:

$f_1$ is the oscillating frequency (pressure oscillation) to be damped at the wall zone 17 of the duct 11, i.e. at zones within the duct 11 that are close to the wall, e.g. at the outer part of the flame, $f_2$ is the oscillating frequency (pressure oscillations) to be damped at a centre zone 18 of the duct 11, e.g. at the inner or centre part of the flame, $\lambda_{conv}$ is the convective wave length, i.e. the flow velocity v through the duct divided by the frequency that should be addressed with the concept, v is the fluid flow speed through the duct 11.

Acoustic node defines the change of sign of the pressure with reference to the nominal pressure.

Figure 7:
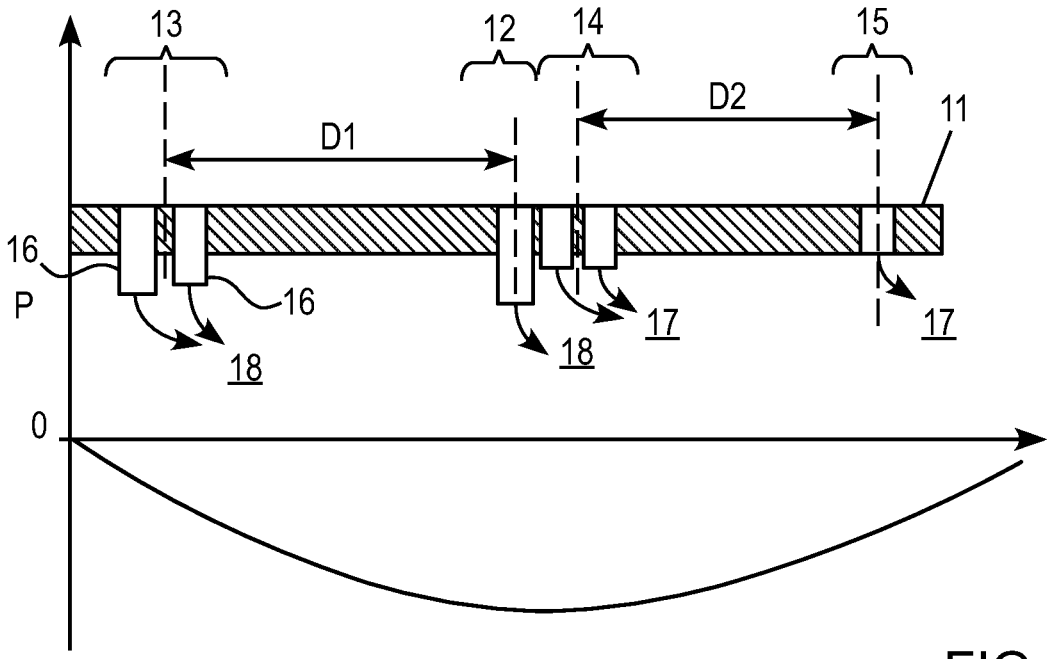
FIG. 7 shows an example of injectors comprising more rows of nozzles.

In addition, the distances D1 and D2 are measured between the axes of the nozzles 16 of the injectors 12, 13, 14, 15 or, in case an injector comprises more rows of nozzles 16 (all injecting into the same zone being the centre or the wall zone), with reference to an average position between the two or more axes of the nozzles 16 of this injector (see e.g. FIG. 7).

Figure 5:
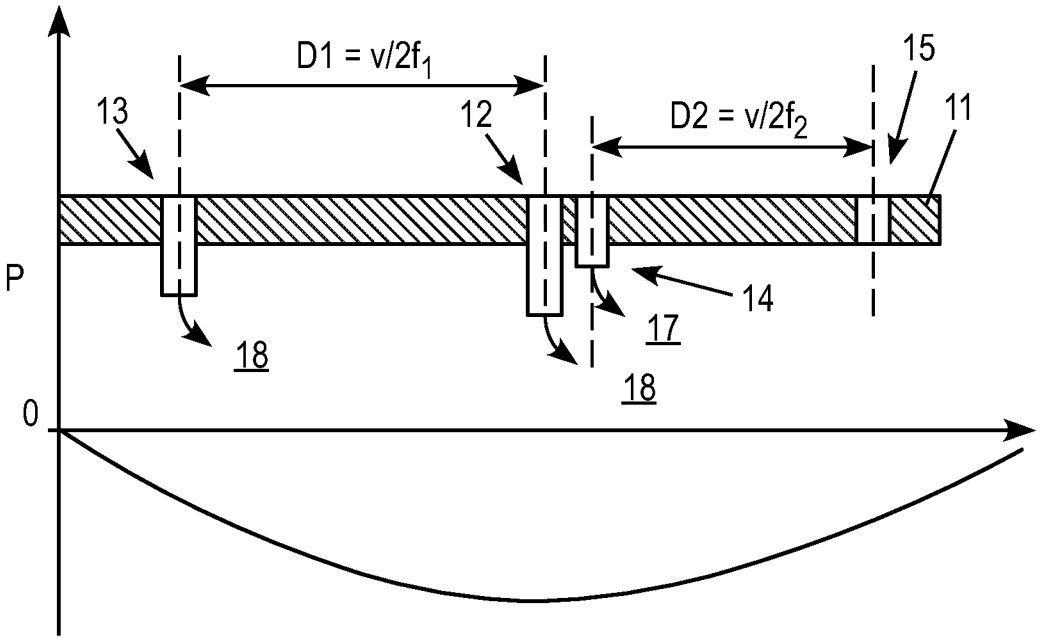
FIGS. 5 and 6 show the distance between the first, second, third, fourth injectors, in relation with the pressure within the mixer itself; in those figures the reference 0 identifies the nominal pressure within the mixer.

As an example, FIG. 5 shows one wall of the duct 11 and the pressure in relation to an axial coordinate thereof. From this figure it can be acknowledged that the distance of the first injector 12 from the second injector 13 is D1=$\lambda_{conv}$/2=v/2$f_1$ and likewise the distance of the third injector 14 from the fourth injector 15 is D2=$\lambda_{conv}$/2=v/2$f_2$ because in this example between the first and second injectors 12, 13 and third and fourth injectors 14, 15 no acoustic nodes are present.

Figure 6:
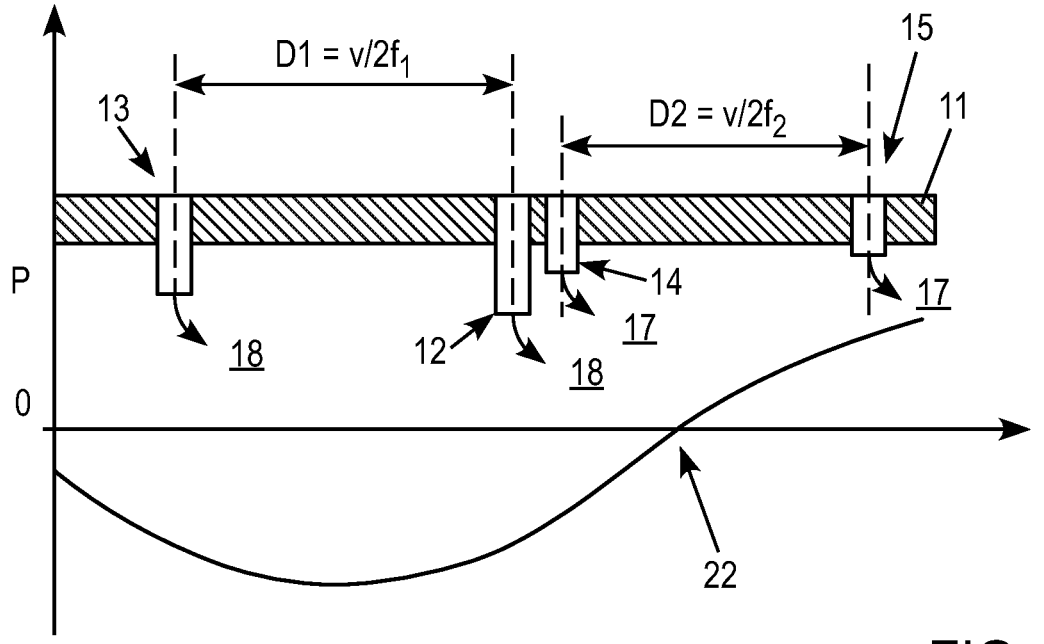

FIG. 6 is similar to FIG. 5; from this figure it can be acknowledged that the distance of the first injector 12 from the second injector 13 is D1=$\lambda_{conv}$/2=v/2$f_1$ because there is no acoustic node between them and the distance of the third injector 14 from the fourth injector 15 is D2=$\lambda_{conv}$=v/$f_2$ because an acoustic node is provided between them (the acoustic node being identified by reference 22).

Advantageously, $f_1$ is greater than $f_2$. Both $f_1$ and $f_2$ are low frequencies e.g. below 150 Hz.

The operation of the mixer and gas turbine having such a mixer is apparent from that described and illustrated and is substantially the following.

Air is compressed at the compressor 2 and is supplied into the burner 3*a* where fuel is supplied and mixed with the compressed air, generating a mixture that combusts in the combustor 3*b* with a flame 20*a*; the hot gas generated through this combustion passes through the transition piece 3*c* and enters the mixer 4 (in particular the duct 11 of the mixer 4).

At the mixer 4 air is injected into the hot gas via the first, second, third, fourth injectors 12, 13, 14, 15 and via possible additional injectors.

This configuration allows a selective cancellation of the mass flow oscillations, because different zones of the cross section of the duct 11 are responsible for generating pulsations of different frequency. In particular, as indicated above, the zones closer to the duct wall have a higher frequency while the zones farther from the duct walls (i.e. at the centre of the duct) have a lower frequency.

Figure 8:
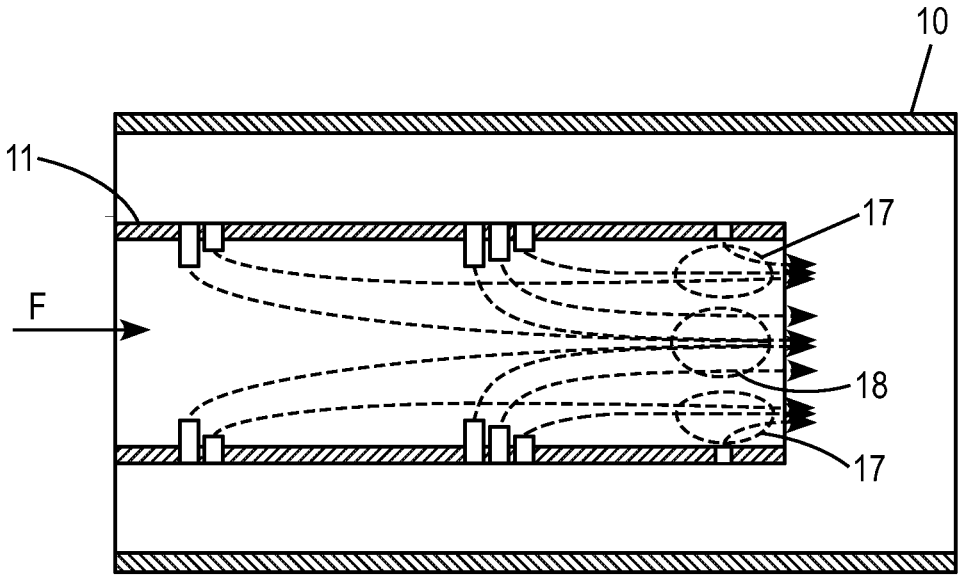
FIG. 8 shows a different embodiment of the mixer.

FIG. 8 shows an example of a mixer having a plurality of injectors (more than four).

Naturally the features described may be independently provided from one another. For example, the features of each of the attached claims can be applied independently of the features of the other claims.

In practice the materials used and the dimensions as well as the injector shapes can be chosen at will according to requirements and to the state of the art.

REFERENCE NUMBERS

1 gas turbine
2 compressor
3 first combustion chamber
3*a* first burner
3*b* combustor
3*c* transition piece
4 second combustion chamber
4*a* second burner
4*b* combustor
5 turbine
7 mixer
8 lance
9 turbine
10 housing
11 duct
12 first injector
13 second injector
14 third injector
15 fourth injector
16 nozzles
17 wall zone
18 centre zone
20*a*, 20*b* flame

22 acoustic node
D1 distance
D2 distance
F flow
$\lambda_{conv}$ convective wave length
v fluid flow speed through the duct

The invention claimed is:

1. A method of dampening oscillating frequencies in a gas turbine mixer, the gas turbine mixer comprising a housing, a duct within the housing, a first injector and a second injector, each arranged to inject a fluid at a center zone of the duct, a third injector and a fourth injector, each arranged to inject the fluid at a wall zone of the duct, the method comprising:

either: (a) injecting the fluid through the first injector at a distance D1=v/2$f_1$, or odd integer multiples of D1, from the second injector in the absence of an acoustic node between the second injector and the first injector, or (b) injecting the fluid through the first injector at a distance D1=v/$f_1$, or full wave length integer multiples of D1, in the presence of an acoustic node between the second injector and the first injector, and either: (c) injecting the fluid through the third injector at a distance D2=v/2$f_2$, or odd integer multiples of D2 from the fourth injector in the absence of an acoustic node between the third injector and the fourth injector, or (d) injecting the fluid through the third injector at a distance D2=v/$f_2$ from the fourth injector in the presence of an acoustic node between the third injector and the fourth injector, wherein $f_1$ is an oscillating frequency to be damped at the wall zone of the duct, $f_2$ is an oscillating frequency to be damped at the center zone of the duct, v is a fluid flow speed through the duct, and $f_1$ is greater than $f_2$.

2. The method of claim 1, wherein both $f_1$ and $f_2$ are lower than 150 Hz.

3. The method of claim 1, wherein the first injector and/or the second injector and/or the third injector and/or the fourth injector comprise a plurality of rows of nozzles close to one another.

4. The method of claim 3, wherein nozzles of different rows of nozzles of the first injector, the second injector, the third injector, or the fourth injector have different penetration.

5. The method of claim 3, wherein nozzles of a same row of nozzles have different penetration.

6. A method of operating a gas turbine, wherein the gas turbine comprises a compressor, a first combustion chamber, a second combustion chamber fed with combustion gases coming from the first combustion chamber, a turbine and a mixer between the first combustion chamber and the second combustion chamber, wherein the mixer comprises a housing, a duct within the housing, a first injector and a second injector, each arranged to inject a fluid at a center zone of the duct, a third injector and a fourth injector, each arranged to inject the fluid at a wall zone of the duct, the method comprising:

either: (a) injecting the fluid through the first injector at a distance D1=v/2$f_1$, or odd integer multiples of D1 from the second injector in the absence of an acoustic node between the second injector and the first injector, or (b) injecting the fluid through the first injector at a distance D1=v/$f_1$, or full wave length integer multiples of D1 in the presence of an acoustic node between the second injector and the first injector, and either: (c) injecting the fluid through the third injector at a distance D2=v/2$f_2$, or odd integer multiples of D2, from the fourth injector in the absence of an acoustic node between the third injector and the fourth injector, or (d) injecting the fluid through the third injector at a distance D2=v/$f_2$ from the fourth injector in the presence of an acoustic node between the third injector and the fourth injector, wherein $f_1$ is an oscillating frequency to be damped at the wall zone of the duct, $f_2$ is an oscillating frequency to be damped at the center zone of the duct, v is a fluid flow speed through the duct, and $f_1$ is greater than $f_2$.

7. The method of claim 6, wherein both $f_1$ and $f_2$ are lower than 150 Hz.

8. The method of claim 6, wherein at least one of the first injector, the second injector, the third injector or the fourth injector comprises a plurality of rows of nozzles close to one another.

9. The method of claim 8, wherein nozzles of different rows of nozzles of the first injector, the second injector, the third injector, or the fourth injector have different penetration.

10. The method of claim 8, wherein nozzles of a same row of nozzles have different penetration.

11. A method of operating a gas turbine, comprising:

combusting a fuel in a first combustion chamber, thereby producing a hot gas;

flowing the hot gas through a mixer; and either: (a) injecting a fluid in the mixer at a first injection location at a distance D1=v/2$f_1$, or odd integer multiples of D1, from a second injection location if there are no acoustic nodes between the second injection location and the first injection location, or (b) injecting the fluid at the first injection location at a distance D1=v/$f_1$, or full wave length integer multiples of D1, if there is at least one acoustic node between the second injection location and the first injection location, and either: (c) injecting the fluid at a third injection location at a distance D2=v/2$f_2$ or odd integer multiples of D2, from a fourth injection location if there are no acoustic nodes between the third injection location and the fourth injection location, or (d) injecting the fluid at the third injection location at a distance D2=v/$f_2$ from the fourth injection location if there is at least one acoustic node between the third injection location and the fourth injection location, wherein $f_1$ is an oscillating frequency to be damped at a wall zone of a duct of the mixer, $f_2$ is an oscillating frequency to be damped at a center zone of the duct, v is a fluid flow speed through the duct, and $f_1$ is greater than $f_2$.

12. The method of claim 11, wherein injecting the fluid in the mixer at the first injection location includes injecting the fluid at the center zone of the duct.

13. The method of claim 11, wherein injecting the fluid at the third injection location includes injecting the fluid at the wall zone of the duct.

14. The method of claim 11, comprising directing a mixture of the hot gas and the injected fluid to a second combustion chamber of the gas turbine.

15. The method of claim 11, wherein both $f_1$ and $f_2$ are lower than 150 Hz.

16. The method of claim 11, wherein the mixer comprises at least a first injector, a second injector, a third injector and a fourth injector and wherein at least one of the first injector, the second injector, the third injector or the fourth injector comprises a plurality of rows of nozzles close to one another.

17. The method of claim 16, wherein nozzles of different rows of nozzles of the first injector, the second injector, the third injector, or the fourth injector have different penetration.

18. The method of claim 16, wherein nozzles of a same row of nozzles have different penetration.

* * * * *